United States Patent [19]

Gasper

[11] 4,112,999

[45] Sep. 12, 1978

[54] CONVEYOR CONTROL SYSTEM

[75] Inventor: Stephen A. Gasper, Lansing, Mich.

[73] Assignee: Roberts Corporation, Lansing, Mich.

[21] Appl. No.: 775,164

[22] Filed: Mar. 7, 1977

[51] Int. Cl.[2] ..... B22C 19/04; B22C 25/00

[52] U.S. Cl. ..... 164/154; 164/168; 164/348; 198/571; 198/577; 198/855

[58] Field of Search ..... 164/154, 168, 323, 150, 164/348, 187, 128, 4; 198/571, 575, 576, 577, 721, 725, 855

[56] References Cited

U.S. PATENT DOCUMENTS

| | | | |
|---|---|---|---|
| 3,556,196 | 1/1971 | Buhler | 164/187 X |
| 3,800,935 | 4/1974 | Montgomery | 198/572 |
| 3,822,009 | 7/1974 | Richards | 198/575 X |
| 4,040,472 | 8/1977 | Lundsgart | 164/154 |

*Primary Examiner*—Francis S. Husar
*Assistant Examiner*—Gus T. Hampilos
*Attorney, Agent, or Firm*—Miller, Morriss & Pappas

[57] ABSTRACT

A cooling conveyor control system which selectively controls a mold cooling conveyor assembly adapted to receive poured molds from the pouring rails of an automatic molding machine and transport them to a collecting conveyor or shakeout mechanism in a continuous or selectively spaced apart mold string. A cooling conveyor control system is provided whereby the cooling conveyor is indexed to move synchronously in response to corresponding operation of the molding machine. The control system includes an electronic controller which processes information received from the control system of the molding machine with feedback information from the hydrostatic drive of the cooling conveyor so as to produce a signal which operates a servo valve to correspondingly control the drive system of the cooling conveyor assembly. The electronic controller acts in response to signals from the control system of the molding machine so as to index the cooling conveyor forward at the precise acceleration, deceleration, and pitch required to maintain a continuous mold string from the molding machine to the collecting conveyor or shakeout.

5 Claims, 4 Drawing Figures

CONVEYOR CONTROL SYSTEM

This invention relates to a mold cooling conveyor assembly having a drive system which is selectively controlled by signals directly from the mold machine control system associated therewith so as to receive poured molds from the pouring rails of an automatic molding machine and transport them to a collecting conveyor or a shakeout mechanism in a continuous or selectively spaced apart mold string. More specifically, this invention relates to a control system for a mold cooling conveyor which includes an electronic controller which processes signals received from the control system of the molding machine with feedback information from the hydrostatic drive of the cooling conveyor so as to synchronously index the cooling conveyor forward at the precise acceleration, deceleration, and pitch required to maintain a continuous mold string from the molding machine to a collecting conveyor or shakeout.

The automatic mold machine with which the automatic cooling conveyor is utilized is commercially available under the trademark DISAMATIC and is produced by DASK INDUSTRI SYNKIDAT A/S of Copenhagen, Denmark. The basic operation of the mold machine is well known in the art and will not be shown or described in detail herein. Suffice it to say that an automatically controlled squeeze ram provided in the automatic mold machine pushes each completed mold from the mold machine into contact with the string of previously produced molds.

As the squeeze ram of the mold machine continues its forward stroke, it incrementally advances the mold string along pouring rails where molten metal is poured into each mold as it sequentially passes through the pouring station above the pouring rails. The mold string is also simultaneously advanced onto and along an automatic cooling conveyor which sequentially receives the poured molds from the pouring rails in response to the forward movement of the squeeze ram.

It has been found that as the length of the mold string increases, the increasing pressure exerted therealong to move the mold string tends to damage or destroy the individual sand molds forming the mold string. Thus, the cooling conveyors in use with automatic mold machines, such as the DISAMATIC mold machine, are self-powered and move in response to corresponding operation of the mold machine.

An example of such a prior art automatic cooling conveyor is shown and described in the U.S. Pat. Montgomery No. 3,800,935.

The conveyor control system of Montgomery U.S. Pat. No. 3,800,935 controls the conveyor drive motor in direct response to the sensed ram pressure during the period that the ram has engaged the mold string and the time that the ram reaches the end of its stroke. The ram pressure is sensed by a pressure transducer which forms a part of the Montgomery invention. Thus, in the Montgomery device, movement and speed is controlled by the sensed pressure created by the squeeze ram. The drive motor of the conveyor is not actuated until it receives a signal from the pressure transducer as described above. Further, the speed of the conveyor is directly controlled by and varies directly with changes in the sensed ram pressure.

It is thus seen that in the prior known art devices a pressure is imposed on the mold string and must be sensed before the conveyor drive motor is actuated. On the other hand, the instant invention utilizes the signals from the control system of the mold machine to diectly operate the control system of the cooling conveyor. As the squeeze ram of the DISAMATIC pushes a new mold to the point just prior to contact with the last mold of the mold string, a mold close-up relay in the DISAMATIC mold machine is activated which signals the DISAMATIC control system. In the instant invention, the foregoing signal from the DISAMATIC mold close-up relay is simultaneously applied to activate the conveyor control system so as to cause immediate movement of the cooling conveyor. There is no delay to sense the force of the DISAMATIC squeeze ram so as to control the speed of the conveyor as in the case of the control system disclosed and claimed in Montgomery U.S. Pat. No. 3,800,935.

It is thus seen that in the preferred embodiment, the DISAMATIC mold close-up signal is applied to the electronic conveyor control system. As will be hereinafter described, pre-track acceleration is created in the cooling conveyor. Subsequently, it is the control system of the DISAMATIC mold machine which determines the output control signal which controls the speed of the cooling conveyor. The signals from the molding machine control system determine the point at which the conveyor is started, operated and stopped.

During automatic operation of the preferred embodiment, the electronic controller causes the cooling conveyor to index synchronously with the DISAMATIC molding machine during the mold delivery operation or sequence of the mold machine. The sequence is initiated when the DISAMATIC'S squeeze ram has pushed the new mold to the point where the DISAMATIC'S mold close-up relay is activated. Upon receipt of the signal from the mold close-up relay, the cooling conveyor controller switches to a "track" mode and the conveyor will index synchronously with the operation of the molding machine. The Accumulator Relief Flow Control of the DISAMATIC is activated during the same period which the mold close-up relay is activated. This allows some of the oil from the high pressure side of the DISAMATIC'S main accumulator through on metered orifice to the DISAMATIC'S oil tank, thereby reducing the rate of pressure increase on the DISAMATIC'S squeeze ram.

At the beginning of the "track" mode, a start track impulse generator is activated and the DISAMATIC Pump Command signal is allowed into the electronic controller. The start track impulse will aid in rapidly accelerating the cooling conveyor as it follows the speed commanded by the DISAMATIC Pump Command.

During the "track" mode, i.e. after "mold touch" and before the end of the mold delivery operation of the DISAMATIC mold machine, the cooling conveyor's maximum velocity will be limited to a point slightly slower than the maximum attempted velocity of the molding machine. The force of the squeeze ram will be limited by the accumulator relief flow control of the molding machine.

A deceleration detector is provided to activate the deceleration impulse generator when the molding machine has been caused to decelerate below the maximum velocity setting of the cooling conveyor. The control signal from the deceleration impulse generator will insure a rapid smooth deceleration of the cooling conveyor at a rate equal to or greater than that of the molding machine.

It is therefore an object of this invention to provide an electronic control system for a cooling conveyor which receives its commands from the control system of the automatic mold machine with which it is associated.

Another object of this invention is to provide an electronic control system for a cooling conveyor which acts in response to signals from the control system of the automatic mold machine in association therewith so as to index the cooling conveyor forward at the precise acceleration, deceleration and pitch required to maintain a continuous mold string from the molding machine to the collecting conveyor or shakeout.

Yet another object of this invention is to provide an electronic control system which is provided with a start track impulse generator to aid in rapidly accelerating the cooling conveyor.

Another object of this invention is to provide an electronic control system which is provided with velocity limitor means for selectively limiting the speed of the cooling conveyor to a point slightly slower than the maximum attempted velocity of the automatic mold machine.

A still further object of this invention is to provide an electronic control system which is provided with a deceleration detector which activates a deceleration impulse generator so as to provide a rapid smooth deceleration of the cooling conveyor at a rate equal to or greater than that of the mold machine.

Other objects will be apparent to those skilled in the art upon reading the present description, drawings and claims.

IN THE DRAWINGS

DESCRIPTION

Figure 1:
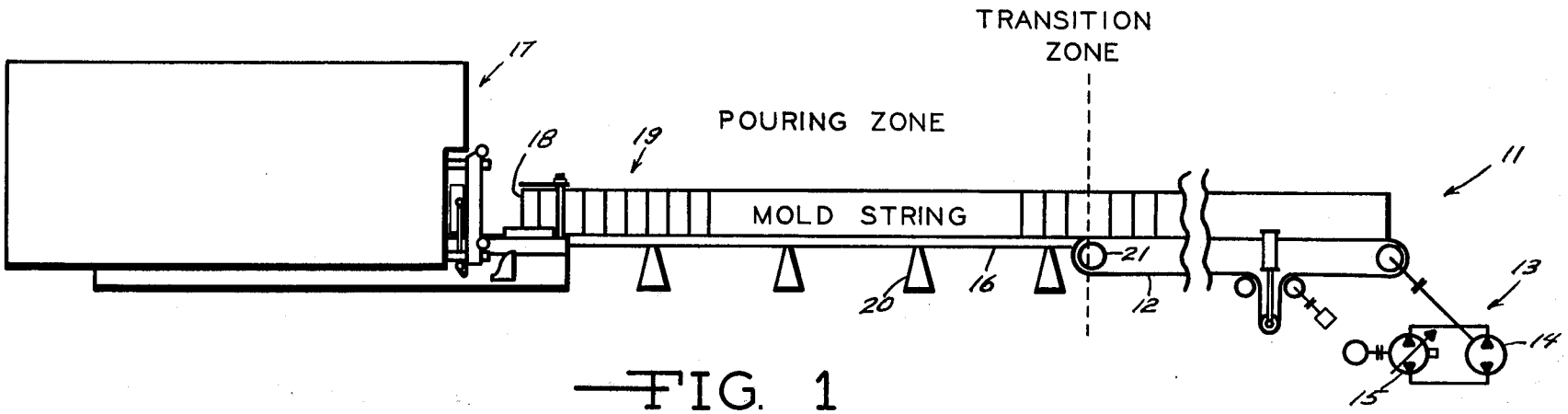
FIG. 1 is a schematic view showing the automatic cooling conveyor in association with a mold machine and further illustrating the continuous mold string positioned thereon.

As shown in FIG. 1, the automatic cooling conveyor assembly 11 is comprised of a conveyor belt 12 driven by a drive assembly 13. The drive assembly 13 is comprised of a hydraulic motor 14 which is controllably driven by a servo-controlled variable displacement pump 15.

The cooling conveyor assembly 11 is positioned in end-to-end abutting relationship with and extending outwardly from the pouring rail 16. The pouring rail 16 is positioned adjacent the DISAMATIC automatic molding machine 17, and is adapted to receive successive completed molds 18 therefrom so that a continuous mold string 19 is formed thereon. In the preferred embodiment, the pouring rail 16 is a standard 6 meter DISAMATIC pouring rail mounted on a plurality of fixed supports 20. As indicated, while positioned on the pouring rail 16, the completed molds 18 are moved through a pouring zone and metal from a pouring ladle (not shown) is selectively poured into each mold. After pouring, the molds 18 are successively pushed onto the cooling conveyor belt 12 as will be hereinafter described. The tail pulley 21 of the cooling conveyor 11 is positioned at the same elevation as the pouring rail 16 and, thus, a smooth transition of the mold string 19 from the pouring rail 16 to the conveyor belt 12 is accomplished. It is within the scope of the invention that the movement of the conveyor belt 12 be programmed so that the molds 18 forming the mold string 19 are positioned in a spaced apart relationship with each other after they are moved onto the conveyor belt 12.

After the molding machine has produced a mold, a squeeze ram (not shown) provided therein pushes the completed mold from the molding machine 17 into contact with the preceding molds 18 on the pouring rail 16 so that the continuous mold string 19 is formed thereon.

As the squeeze ram of the molding machine 17 pushes the newly completed mold 18 into contact with the mold string 19, a mold close-up relay switch (not shown) in the molding machine is activated. In practice, the mold close-up relay switch is activated just prior to actual contact of the newly completed mold 18 with the mold string 19. As will be hereinafter discussed in greater detail, this mold close-up relay signal from the molding machine is transmitted to the conveyor control means and the cooling conveyor indexes forward synchronously with mold delivery operation of the molding machine. As the molding machine completes new molds 18, they are thus sequentially moved into contact with the mold string 19 by the stroke of the squeeze ram of the molding machine.

The continuing forward stroke of the squeeze ram causes the mold string 19 to incrementally move along the pouring rail 16 so that, as a new mold is added to the mold string 19, a mold is pushed from the pouring rail onto the conveyor belt 12. The synchronous movement of the cooling conveyor relieves the pressure on the molds created by the squeeze ram as it advances each new mold. In this way, the squeeze ram does not push (advance) the entire string of molds and, hence, damage to the individual molds is avoided.

An accumulator relief flow control (not shown) is activated during the same period in which the mold close-up relay is activated. This allows some of the oil from the high pressure side of the DISAMATIC'S main accumulator to pass through a metered orifice to the DISAMATIC'S oil tank, thereby reducing the rate of pressure increase on the squeeze ram. This avoids a fast pressure build-up during the short period of time when the mold close-up relay switch is activated.

Figure 3:
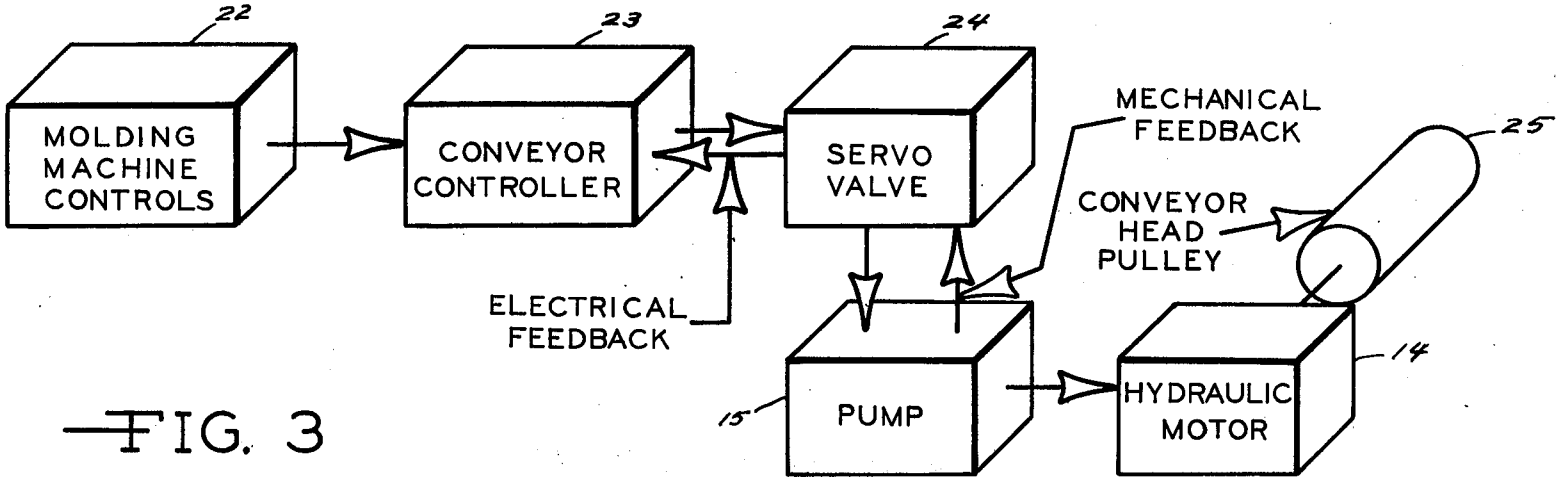
FIG. 3 is a schematic view illustrating the DISAMATIC control system, the automatic cooling conveyor control system and the cooling conveyor drive assembly controlled thereby.

As shown schematically in FIG. 3, the molding machine controls 22 actuate the conveyor control means 23 which in turn selectively actuates the servo control means 24. The servo control means 24 in turn selectively actuate the variable displacement pump 15 which actuates the hydraulic motor 14 so as to drive the conveyor head pulley 25.

Figure 4:
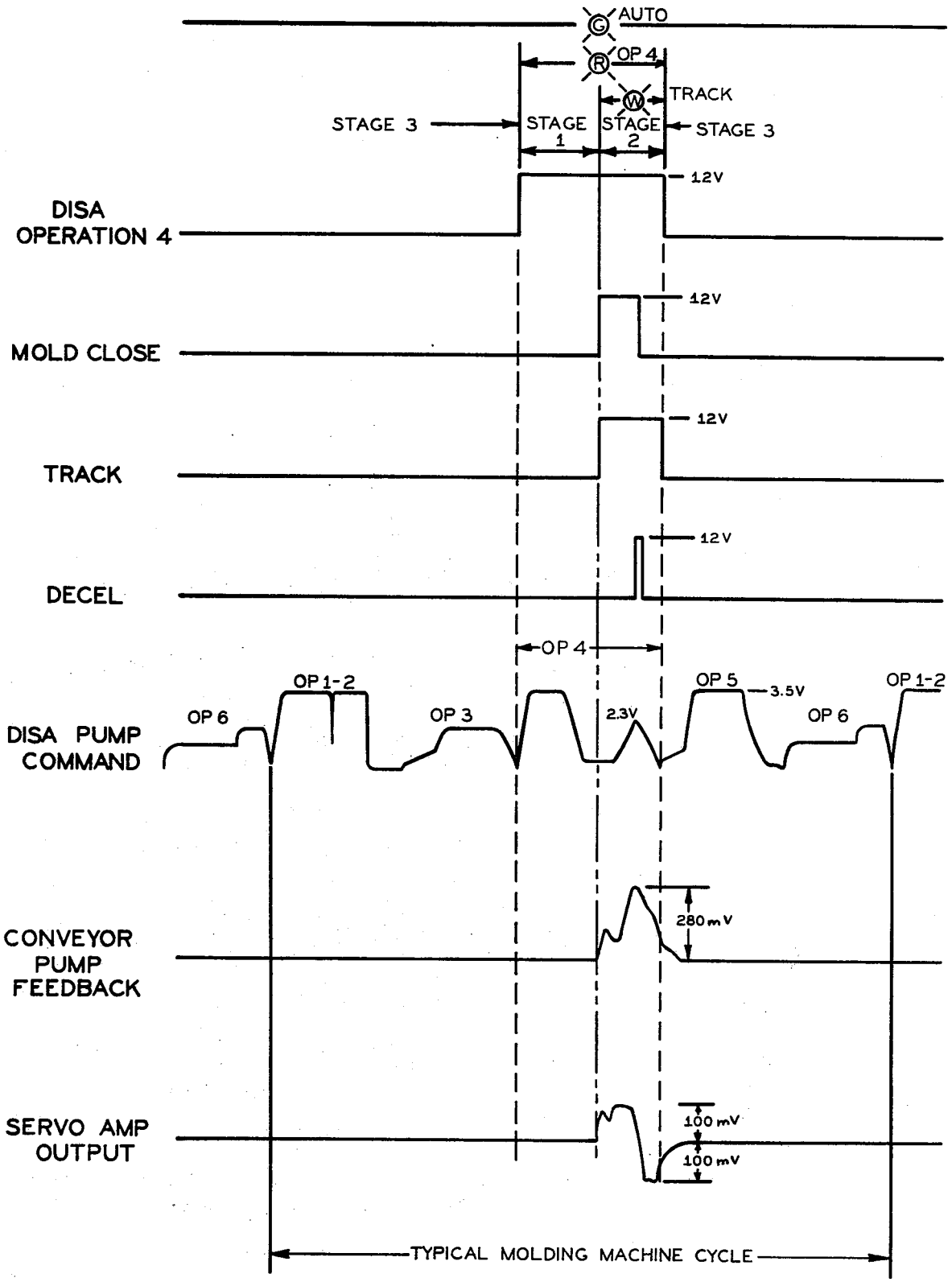
FIG. 4 is a diagram view of the various control signals generated by the cooling electronic system in response to the signals received from the DISAMATIC mold machine control system.

The heart of the DISAMATIC control system (not shown) is a mechansim comprising several cams which cause a cam follower to sequentially operate the automatic mold machine through its various mold making operations. The cam generated control signals given by the DISAMATIC control system are schematically shown in FIG. 4 and are identified as the DISAMATIC PUMP COMMAND. As indicated, the DISAMATIC mold machine is automatically diected or controlled through various mold making operations, i.e. OP 1 (blow sand), OP 2 (squeeze mold), OP 3 (open door), OP 4 (mold delivery), OP 5 (retract squeeze ram) and OP 6 (close door). As described herein, the electronic control system for the mold cooling conveyor embodied in the instant invention is activated and operated by signals generated by the DISAMATIC PUMP COMMAND during the DISAMATIC Operation 4 (OP 4), the completed mold delivery operation. This is shown in FIG. 4.

Figure 2:
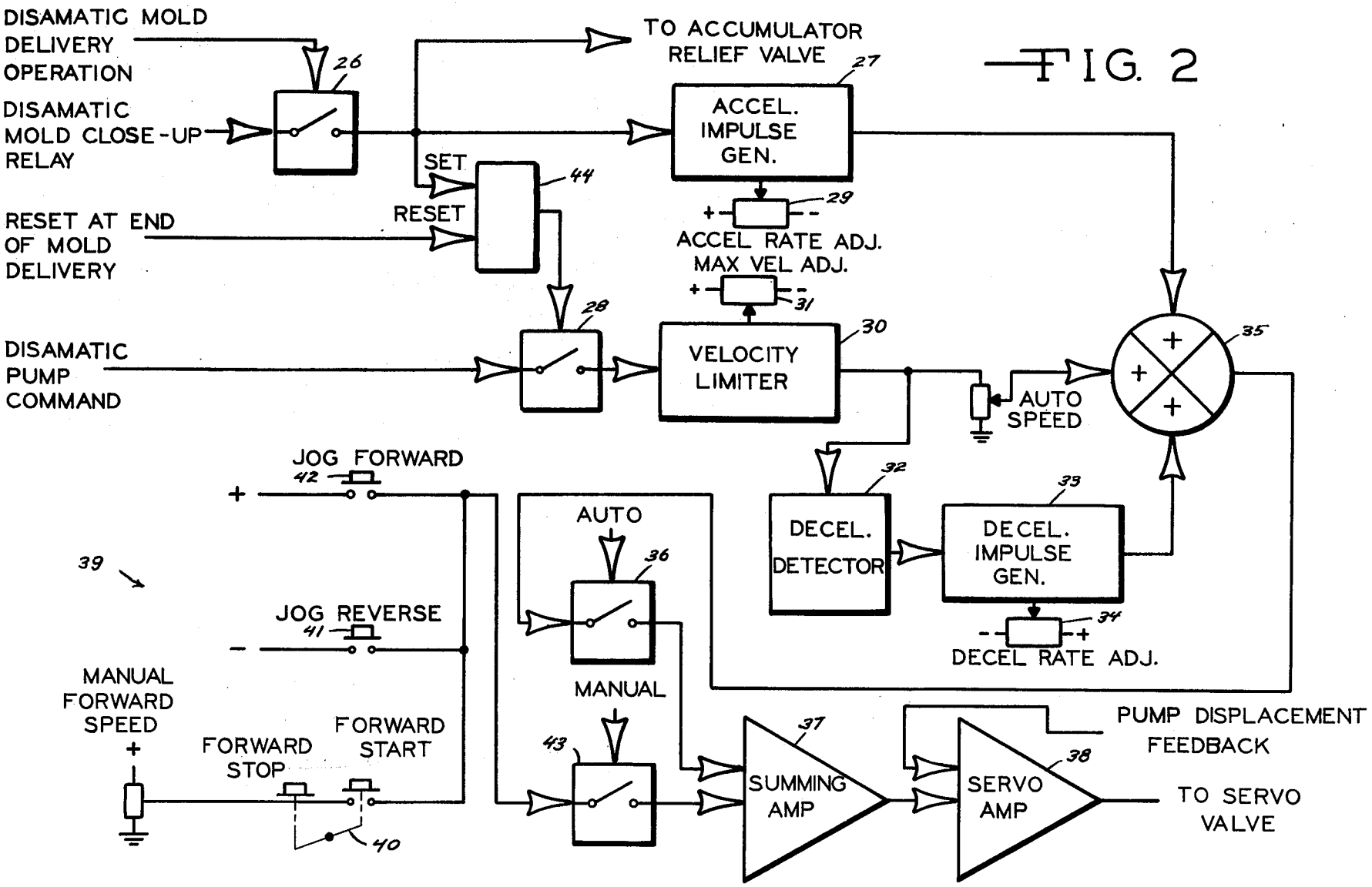
FIG. 2 is a diagram view illustrating the electronic controller system for the automatic cooling conveyor.

As shown in FIG. 2, operation of the electronic cooling conveyor controller is initiated when the molding machine shfits to its mold delivery operation (Operation 4) to close switch 26. As the squeeze ram of the mold machine 17 pushes the new mold 18 out of the mold machine 17, the DISAMATIC Mold Close-Up relay is activated just prior to the point of contact of the new mold 18 with the mold string 19. The signal from the DISAMATIC Mold Close-Up relay is used to close switch 26 so as to place the electronic cooling conveyor into the "track" made whereby the cooling conveyor belt 12 indexes synchronously with the molding machine 17. The Accumulator Relief Flow Control valve (not shown) is activated during the same period which the DISAMATIC Mold Close-Up relay is activated. This allows some of the oil from the high pressure side of the DISAMATIC'S main accumulator through a metered orifice to the DISAMATIC'S oil tank (not shown), thereby reducing the rate of pressure increase on the squeeze ram.

As further shown in FIG. 2, the acceleration or "start track" impulse generator 27 is initially activated at the start of the sequence and the DISAMATIC PUMP COMMAND signal is allowed into the electronic controller through switch 28. The acceleration impulse generator 27 comprises an electronic circuit capable of generating a single pulse whose amplitude can be controlled by external adjustment means 29. The signal generated by the impulse generator 27 is only of millisecond duration sufficient to initially "jolt" the conveyor into movement.

During the movement of the conveyor, the velocity limiter 30 acts to limit the conveyor's maximum velocity to a point slightly slower than the maximum attempted velocity of the molding machine. The velocity limiter 30 comprises an electronic circuit capable of limiting the velocity of the cooling conveyor as desired and includes external adjustment means 31. During this period, the force of the squeeze ram is limited by the molding machine's relief valve. A deceleration detector 32 is provided to activate the deceleration impulse generator 33 when the molding machine has begun to decelerate below the maximum velocity setting of the cooling conveyor. The deceleration impulse generator 33 comprises an electronic circuit capable of providing a rapid smooth deceleration of the cooling conveyor at a rate equal to or greater than that of the molding machine and includes external adjustment means 34.

The signals from the the accelerator impulse generator 27, the velocity limiter 30 and the deceleration impulse generator 33 are fed into the first summing amplifier 35. The resultant amplifier signal is then directed through the automatic operation switch 36 into the second summing amplifier 37. The resultant signal goes into the servo amplifier 38 which actuates a servo valve 24 as shown in FIG. 3. The servo valve 24 then acts to displace place the hydraulic fluid necessary to drive the variable displacement pump 15 which varies the speed of the hydraulic motor 14. As shown in FIGS. 2 and 3, there is a pump displacement feedback to the servo amplifier 38 to automatically compensate between the variable displacement pump 15 and the fixed displacement motor 14. The hydraulic motor 14 drives the conveyor head pulley 25 so as to move the cooling conveyor 11 synchronously with the molding machine 17.

As shown in FIG. 2, a manual control system 39 is provided for manual control of the conveyor 11 for maintenance purposes and the like. The manual control system 39 comprises a forward stop and start switch 40, a jog reverse switch 41 and a jog forward switch 42. The resultant signals are fed through a manual control switch 43 into the second summing amplifier 37. Thereafter, the conveyor 11 is controlled as previously described.

Upon completion of the mold machine's mold delivery operation (Operation 4), the cooling conveyor movement is terminated and the cooling conveyor controller system is reset by reset switch 44. It should be noted that the voltages indicated in the timing diagram of FIG. 4 are for purposes of illustration only and can vary in the different embodiments and use applications of the instant invention.

It is thus seen that a highly utilitarian cooling conveyor control system is provided which acts in response to signals received directly from the control system of the automatic mold machine with which the cooling conveyor is associated.

Various other modifications of the invention may be made without departing from the principle thereof. Each of the modifications is to be considered as included in the hereinafter appended claims, unless those claims by their language expressly provide otherwise.

I claim:

1. In a cooling conveyor system which includes a mold cooling conveyor and drive means therefor, and an automatic molding machine having a squeeze ram for delivering molds to the mold cooling conveyor and a mold close-up relay switch actuated by movement of the squeeze ram so as to generate a signal which actuates the automatic mold machine control system, comprising:

cooling conveyor control means for selectively controlling the movement of a cooling conveyor synchronously with the movement of the squeeze ram in response to signals received directly from the control system of the automatic mold machine in association therewith;

start track impulse generator means provided in said cooling conveyor control means for initially selectively accelerating the cooling conveyor, said start track impulse generator means actuated by a signal from the mold close-up relay switch activated by the squeeze ram of the automatic mold machine;

velocity limiter means provided in said cooling conveyor control means for selectively limiting the speed of the cooling conveyor to a point slightly slower than the maximum attempted velocity of the squeeze ram of the automatic mold machine;

deceleration impulse generator means provided in said cooling conveyor control means for selectively decelerating the cooling conveyor at a rate equal to or greater than that of the squeeze ram of the automatic mold machine, said deceleration impulse generator controlled by deceleration detector means which senses deceleration of the squeeze ram of the automatic mold machine; and cooling conveyor drive means for selectively driving said cooling conveyor in response to signals from said cooling conveyor control means; and servo valve control means provided in association with said cooling conveyor control means and said cooling conveyor drive means for selectively controlling the speed of the cooling conveyor in selective response to signals received from said cooling conveyor control means, said start track impulse generator means, said velocity limiter means and said deceleration impulse generator means.

2. In the cooling conveyor control system of claim 1 wherein manual control means are provided in association with the cooling conveyor control means so as to provide selective manual control of the cooling conveyor.

3. In the cooling conveyor control system of claim 1 wherein said cooling conveyor drive means include a hydraulic drive motor driven by a servo controlled variable displacement pump.

4. In the cooling conveyor control system of claim 1 wherein said cooling conveyor control means include accumulator relief flow control means which are adapted to reduce the rate of pressure increase of the squeeze ram of the automatic mold machine upon activation of the said cooling conveyor control means.

5. In the cooling conveyor control system of claim 1 wherein a first summing amplifier is provided to process the signals received from said start track impulse generator, said velocity limiter means and said deceleration impulse generator means.

* * * * *